US009974388B1

(12) United States Patent
Lv

(10) Patent No.: US 9,974,388 B1
(45) Date of Patent: May 22, 2018

(54) PORTABLE FOLDING CHAIR

(71) Applicant: Feng Lv, Suzhou (CN)

(72) Inventor: Feng Lv, Suzhou (CN)

( * ) Notice: Subject to any disclaimer, the term of this patent is extended or adjusted under 35 U.S.C. 154(b) by 0 days. days.

(21) Appl. No.: 14/983,555

(22) Filed: Dec. 30, 2015

(30) Foreign Application Priority Data

Dec. 3, 2015 (CN) ..... 2015 2 0986834 U

(51) Int. Cl.
*A47C 4/00* (2006.01)
*A47C 4/28* (2006.01)
*A47C 4/42* (2006.01)

(52) U.S. Cl.
CPC ..... *A47C 4/283* (2013.01); *A47C 4/42* (2013.01)

(58) Field of Classification Search
CPC .. A47C 4/28; A47C 4/286; A47C 4/00; A47C 7/70; A47C 4/283; A47C 4/04; A47C 4/045; A47C 4/06; A47B 3/14
USPC .. 297/37, 16.1, 16.2, 45, 44, 46, 47, 48, 55, 297/54
See application file for complete search history.

(56) References Cited

U.S. PATENT DOCUMENTS 5,058,950 A * 10/1991 Mann ..... A47C 4/286 297/16.2
6,082,840 A * 7/2000 Chau ..... A47B 21/06 108/50.02
6,634,705 B1 * 10/2003 Zheng ..... A47C 4/286 297/41
8,678,490 B2 * 3/2014 Chen ..... A47C 4/283 297/36
8,696,052 B2 * 4/2014 Zhu ..... A47C 4/28 297/36
9,538,840 B2 * 1/2017 Yang ..... A47C 7/70
2003/0025362 A1 * 2/2003 Liu ..... A47C 4/283 297/45
2013/0106145 A1 * 5/2013 Chen ..... A47C 4/283 297/42
2014/0138990 A1 * 5/2014 Chesness ..... A47C 4/286 297/35
2014/0169304 A1 * 6/2014 DiGirolamo ..... H04L 1/0026 370/329
2015/0054314 A1 * 2/2015 Grace ..... A47C 7/70 297/45
2015/0282624 A1 * 10/2015 Baoqing ..... A47C 7/543 297/36
2016/0100688 A1 * 4/2016 Grace ..... A47C 4/286 297/17

* cited by examiner

*Primary Examiner* — Chi Q Nguyen
(74) *Attorney, Agent, or Firm* — Wayne & Ken, LLC; Tony Hom

(57) ABSTRACT

The folding chair comprises a group of foot pipes, a group of seat frame pipes, a group of rotating connection pipes, a group of locking pipes and fabric. The group of foot pipes comprises a left and a right foot pipes. Armrest fixing pieces are fixedly installed on the upper ends of the foot pipes. A limiting piece is fixed in the middle of the foot pipes. A sliding piece is sleeved below the limiting piece. The upper ends of the four rotating pipes are rotatably connected with the seat frame pipes through a seat frame rotating piece; the other end of the four rotating pipes is rotatably connected with another linkage pipe of the four rotating pipes through a rotating piece fixed thereto; the rotating pipes are symmetrically arranged.

5 Claims, 11 Drawing Sheets

PORTABLE FOLDING CHAIR

TECHNICAL FIELD

The invention relates to a folding chair, in particular to a folding chair having the same size as a briefcase, convenient in carrying.

BACKGROUND

Most of the folding chairs currently used in people's outdoor tourism and leisure are connected by pipe racks and fabric. These structures have two disadvantages: 1. after being folded, the structures have too large volume; their sizes are too high when the structures are carried by one hand or placed in a trailer or a car boot, affecting the travel; 2. the bracket is not locked after being folded or a locking structure shall be individually installed on the bracket, which is not convenient for operation.

SUMMARY

The purpose of the invention is to provide a folding mechanism chair which is convenient in folding and can be locked by natural gravity.

To achieve the purpose of the invention, the following technical solution is adopted: A folding chair comprises a group of foot pipes, a group of seat frame pipes, a group of rotating connection pipes and a group of locking pipes; the group of foot pipes comprises a left and a right foot pipes; armrest fixing pieces are fixedly installed on the upper ends of the foot pipes; a limiting piece is fixed in the middle; a sliding piece is sleeved below; four rotating connection pipes are arranged; the upper ends are rotatably connected with the seat frame pipes through a seat frame rotating piece; the other end is connected with another rotating connection pipe through a rotating piece fixed thereto; the rotating connection pipes are symmetrically arranged; a left and a right locking pipes are installed and are symmetrically arranged; the middles of the locking pipes are rotatably connected with the middles of the rotating connection pipes; a locking piece is arranged at the inner end and is rotatably connected with the locking pipe on the other side; the outer end is rotatably connected with the sliding piece sleeved on the foot pipes; a left and a right seat frame pipes are arranged, respectively sleeved on the armrest fixing pieces and rotatably connected with the rotating connection pipes; and the fabric is sleeved on the seat frame pipes.

The armrest pipes are arranged on the armrest fixing pieces of the above briefcase type portable folding chair and can rotate; back rotating pieces are fixedly installed on a back pipe and are rotatably connected with the armrest pipes to form an armrest and back structure of the folding chair.

After a bracket of the above briefcase type portable folding chair is unfolded to a position, the locking pipes symmetrically arranged form an angle from ⌒ shape to ⌣ shape; and the locking pieces fixedly sleeved on the locking pipes are stressed in opposite vertex and naturally locked.

The locking pipes of the above briefcase type portable folding chair simultaneously have two roles, i.e., supporting an unfolded bracket and simultaneously naturally locking a locked structure in a gravity direction, becoming one of innovation points of the structure.

After the above briefcase type portable folding chair is folded, the bracket is compact and can be carried away by one hand like a hand-held briefcase.

The structure of the invention has the following characteristics: (1) The locking pipes of the invention play a role of safely locking the bracket structure while supporting the bracket in a sliding way; integrating two functions into a whole is the characteristic of the invention; (2) in the invention, a locking structure is arranged on the bracket so that the fabric is opened by the bracket and is kept tight; the bracket has better comfort; (3) in the invention, by manually pulling the locking pipes, the bracket can be unfolded or folded, which is convenient in operation; (4) after the bracket of the invention is folded, the volume is small, and the bracket, like a hand-held briefcase, is convenient in carrying; and (5) the armrest pipes and the back pipe can be arranged on the structure of the invention, but fewer space is occupied when the structure is folded, achieving reasonable design and high practicality.

BRIEF DESCRIPTION OF THE DRAWINGS

To clearly understand the contents in the invention more easily, the invention will be further described in detail below in combination with the drawings according to specific embodiments, wherein.

DETAILED DESCRIPTION OF THE DRAWINGS

Figure 1:
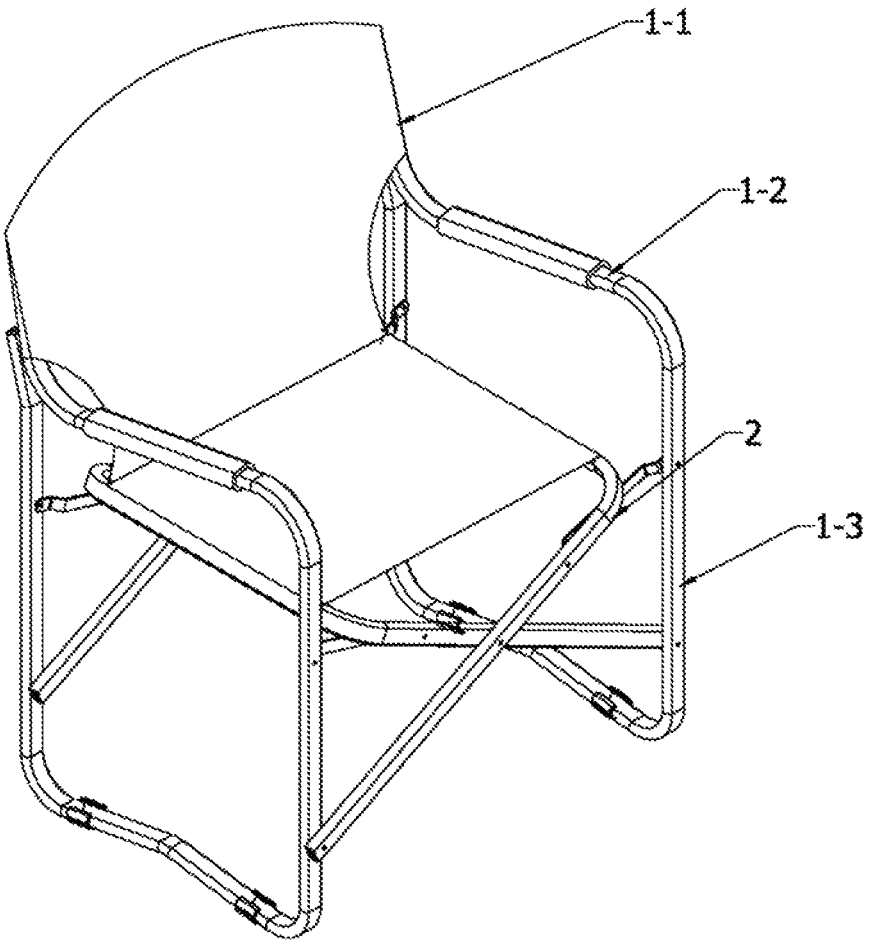
FIG. 1 is a contrast product diagram of the invention.
Figure 2:
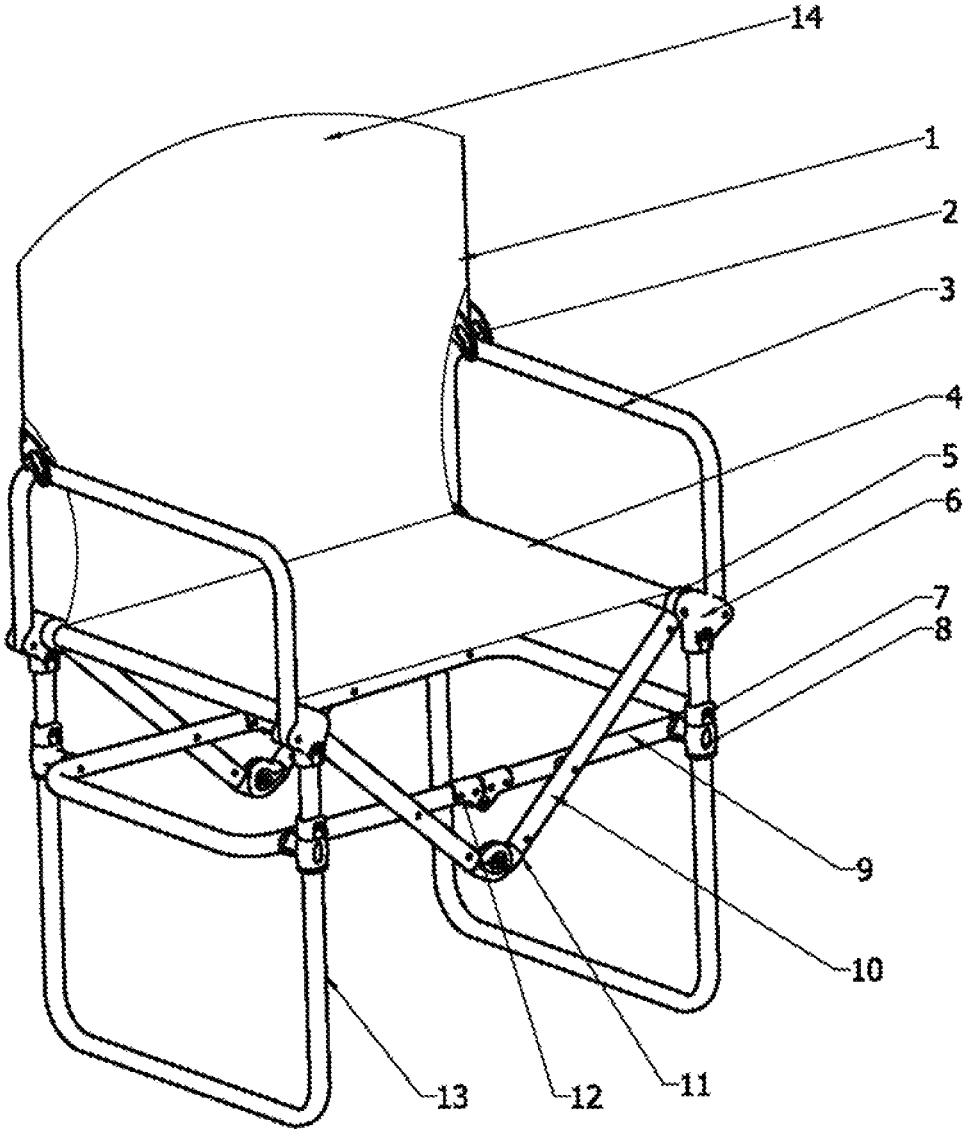
FIG. 2 is a structural diagram of product assembly of the invention.
Figure 3:
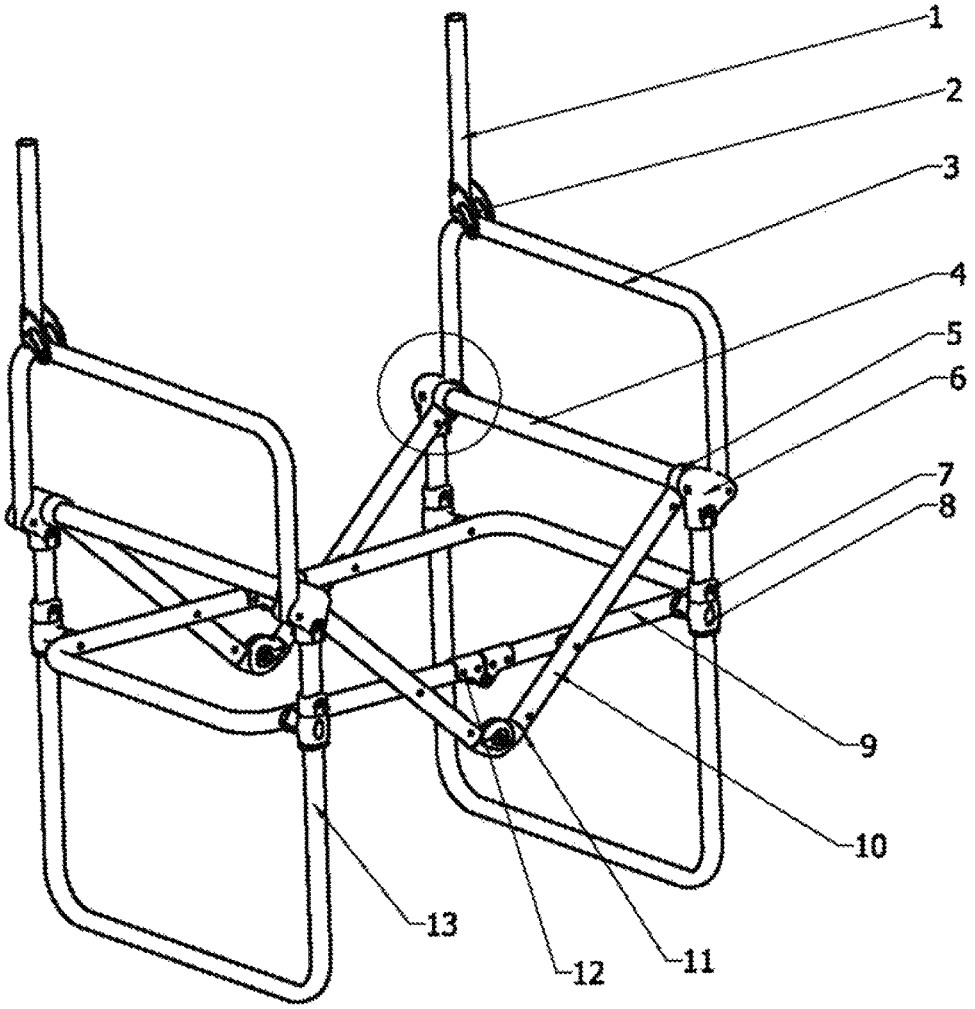
FIG. 3 is a product structural diagram of the invention.
Figure 4:
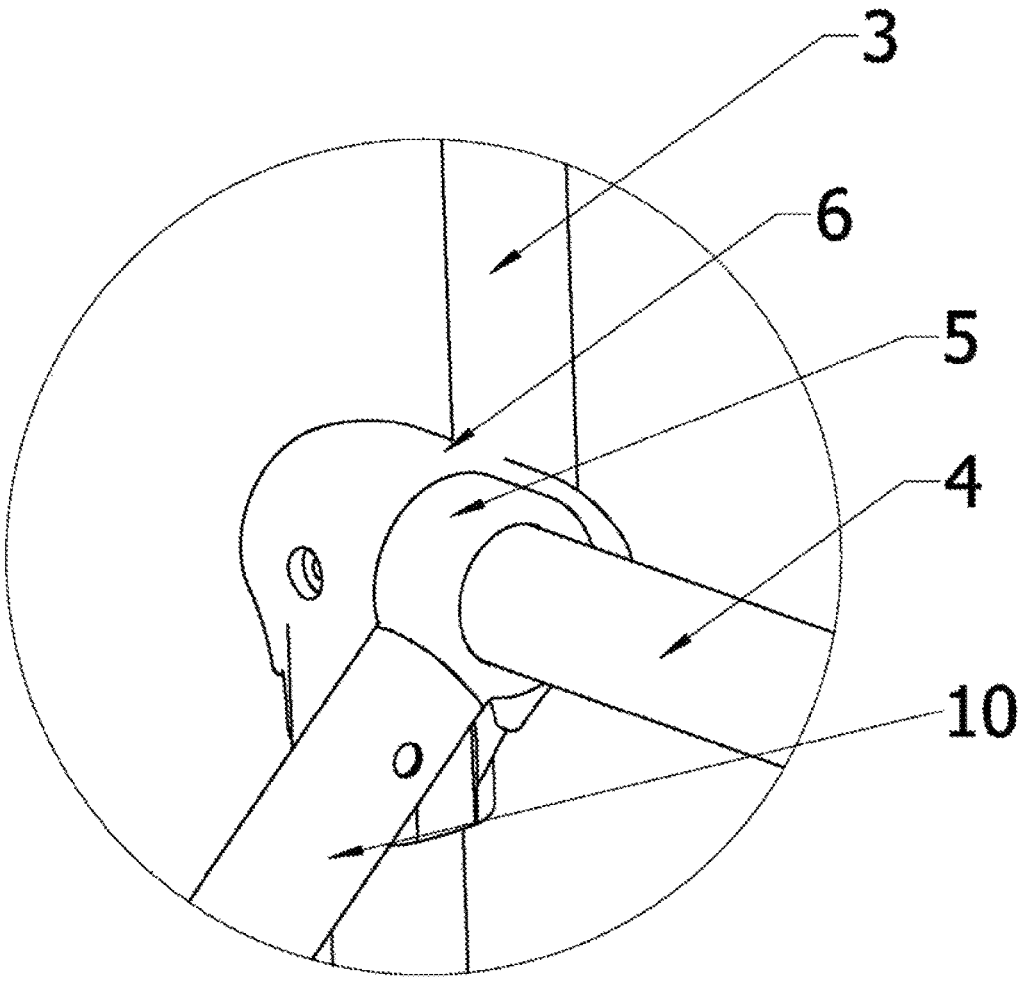
FIG. 4 is a local diagram of the invention.
Figure 5:
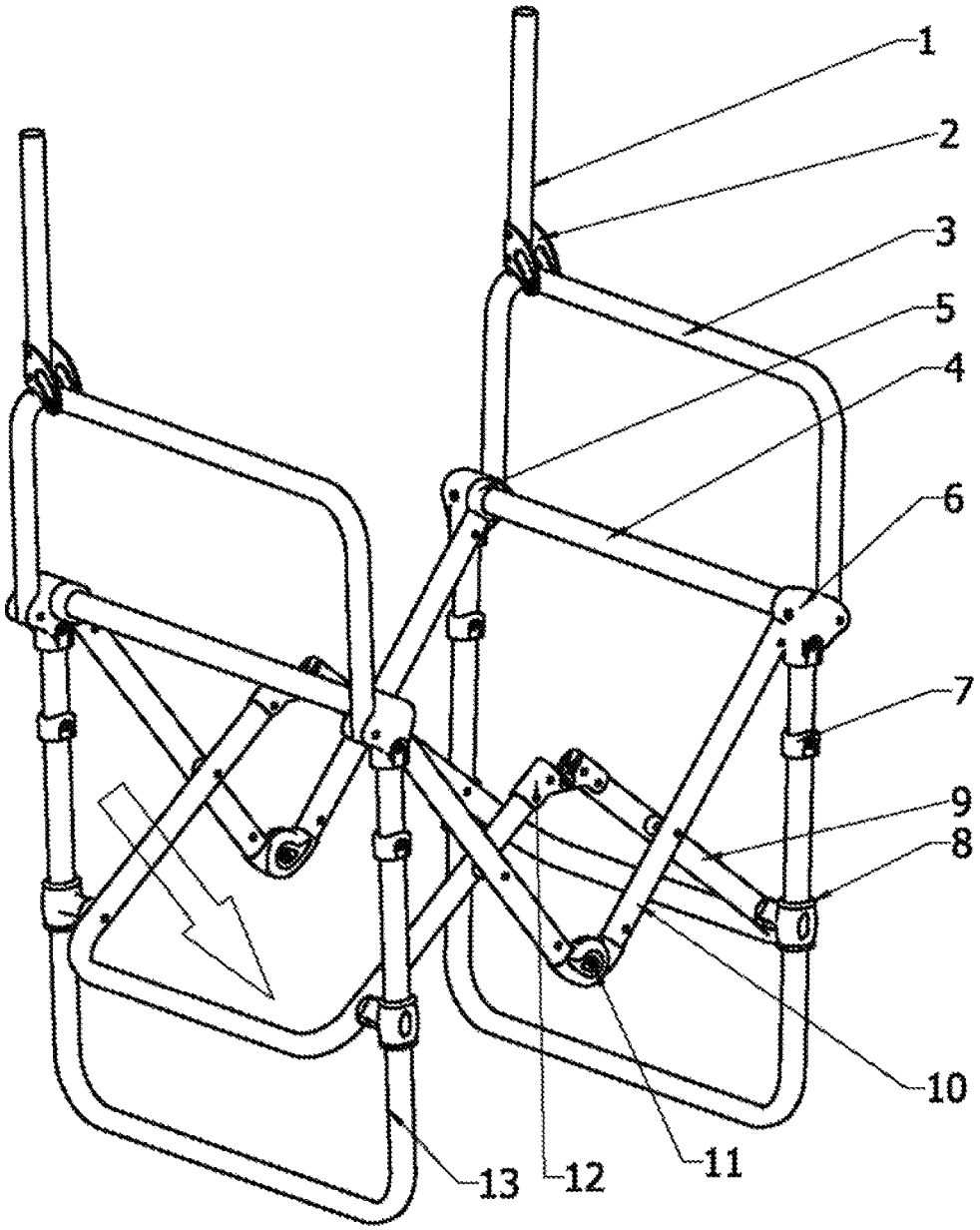
FIG. 5 is a schematic diagram of locking and folding of the invention.
Figure 6:
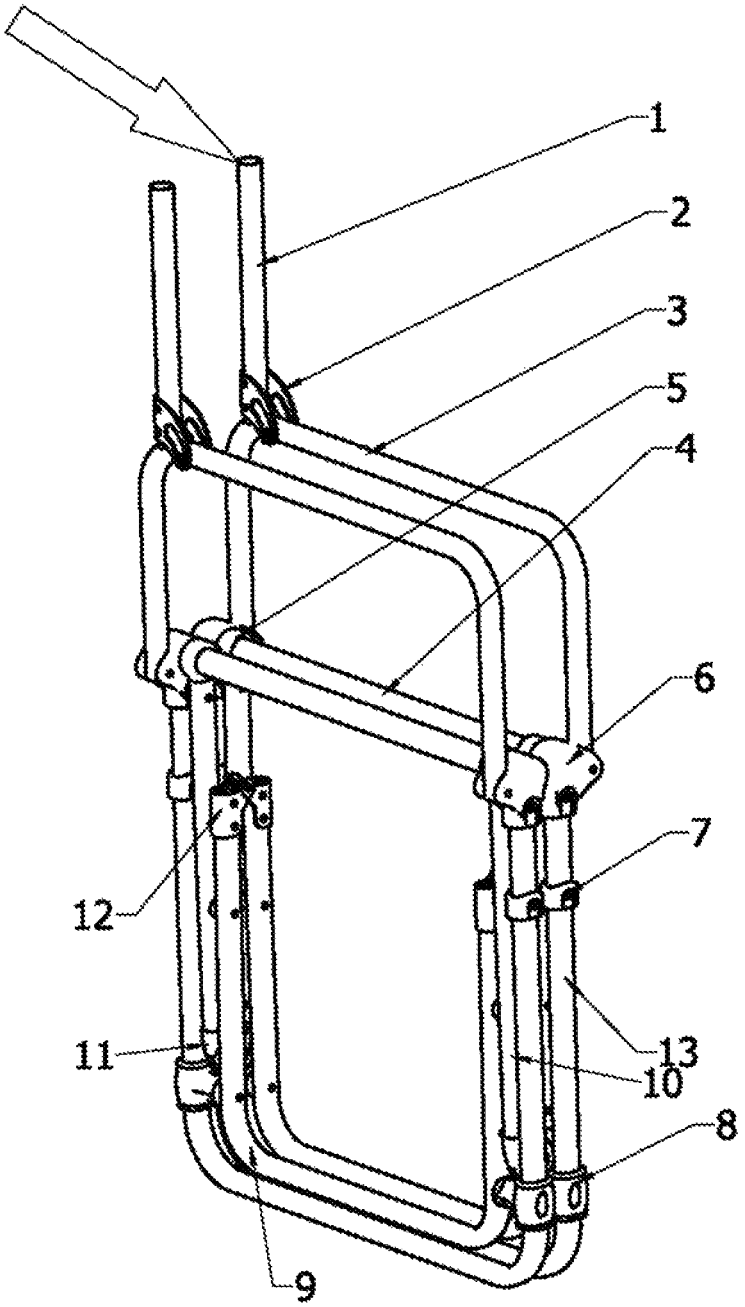
FIG. 6 is a schematic diagram for folding a back pipe of the invention.
Figure 7:
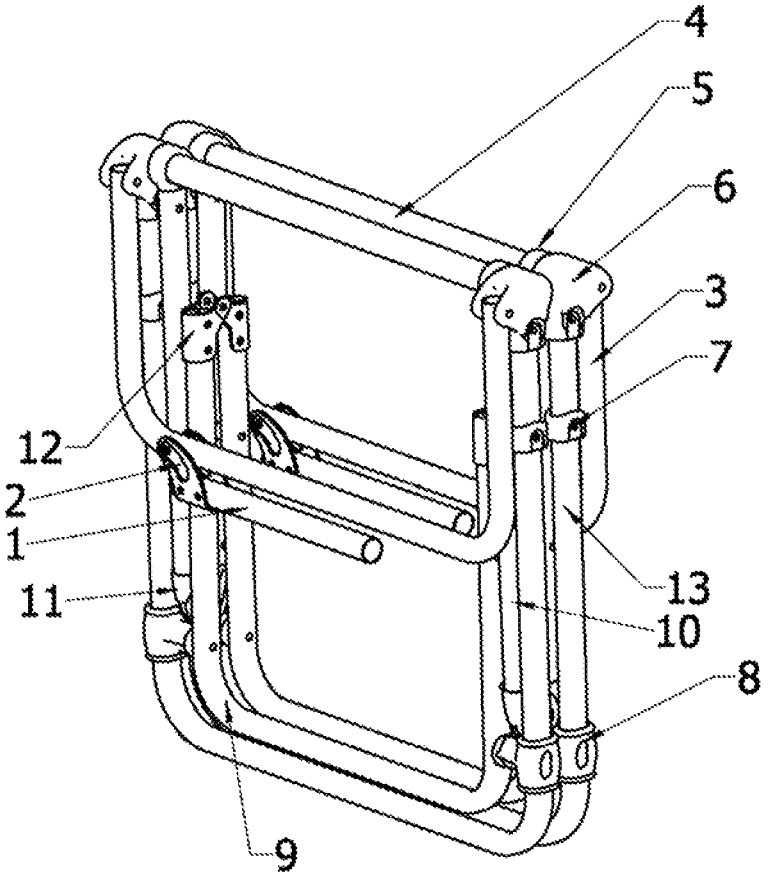
FIG. 7 is a schematic diagram for folding armrests of the invention.
Figure 8:
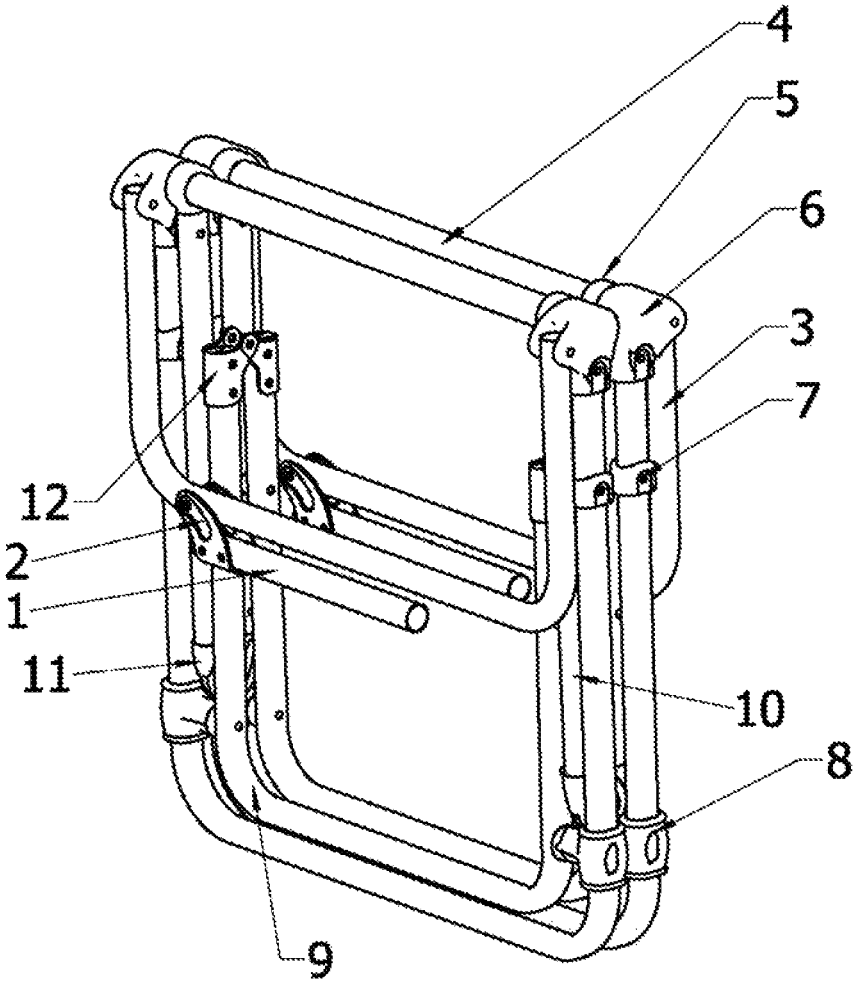
FIG. 8 is a schematic diagram of a hand-held briefcase type.

In FIG. 1: As a contrast diagram of the invention, a back pipe 1-1, armrest pipes 1-2 and foot pipes 1-3 are integrated into a whole; the bracket cannot be folded; a crossed pipe 2 is rotatably connected with a quadrangle between the armrest pipes 1-2; the bracket cannot be folded due to the size and the packaging of the structure is too large.

In FIG. 2 to FIG. 8, the invention comprises a group of foot pipes 13, a group of seat frame pipes 4, a group of rotating connection pipes 10, a group of locking pipes 9 and fabric 14; the group of foot pipes 13 comprises a left and a right foot pipes; armrest fixing pieces 6 are fixedly installed on the upper ends of the foot pipes 13; a limiting piece 7 is fixed in the middle; a sliding piece 8 is sleeved below; four rotating pipes 10 are arranged; the upper ends are rotatably connected with the seat frame pipes 4 through a seat frame rotating piece 5; the other end is rotatably connected with another linkage pipe through a rotating piece 11 fixed thereto; the rotating connection pipes are symmetrically arranged; a left and a right locking pipes 9 are installed and are symmetrically arranged; the middles of the locking pipes 9 are rotatably connected with the middles of the rotating connection pipes 10; a locking piece 12 is arranged at the inner end and is rotatably connected with the locking pipe 9 on the other side; the outer end is rotatably connected with the sliding piece 8 sleeved on the foot pipes 13; a left and a right seat frame pipes 4 are arranged, respectively sleeved on the armrest fixing pieces 6 and rotatably connected with the rotating connection pipes 10; the armrest pipes 3 are rotatably connected to the armrest fixing pieces 6; back rotating pieces 2 are fixedly installed on a back pipe 1 and are rotatably connected with the armrest pipes 3; and the fabric is sleeved on the seat frame pipes 4.

Figure 9:
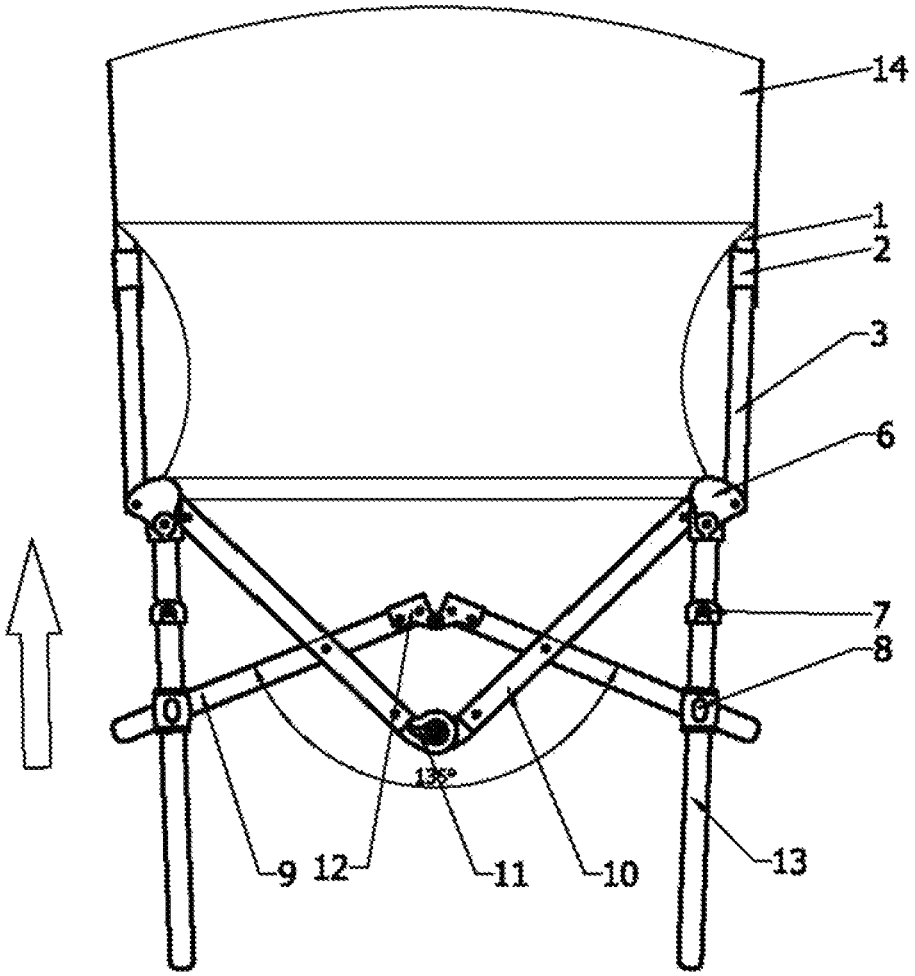
FIG. 9 is a structural diagram for supporting locking pipes in a sliding way.
Figure 10:
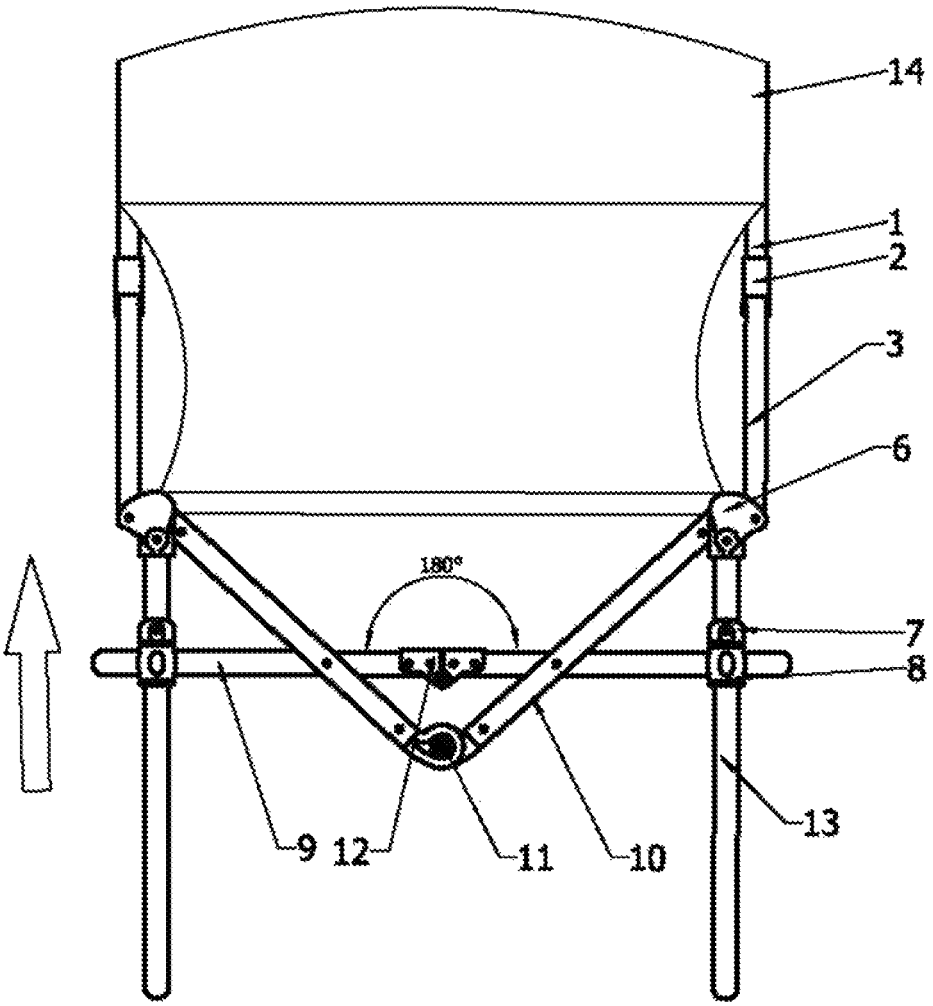
FIG. 10 is a structural diagram that locking pipes form 180° symmetrically.
Figure 11:
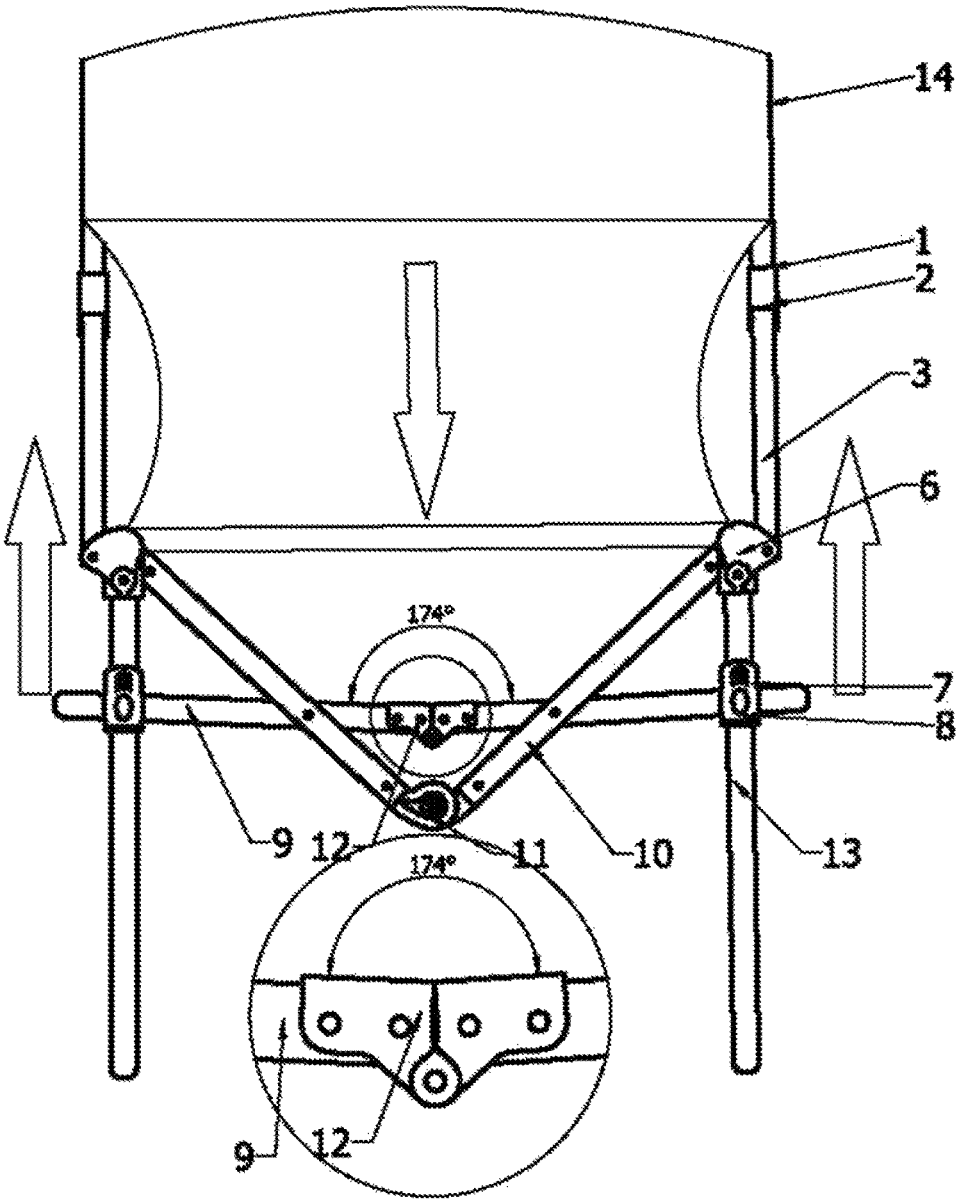
FIG. 11 is a structural diagram of natural locking in V shape of locking pipes.

In FIG. 9 to FIG. 11:

In the implementation of a locking structure of the invention, locking pipes 9 symmetrically arranged initially form an angle ⌒ which is less than 180°. When the locking pipes 9 drive the sliding piece 8 sleeved on the foot pipes 13 to upwards slide together until the locking pipes 8 symmetrically arranged form 180°, the locking pipes 9 slide upwards; the locking pipes symmetrically arranged form a V shape; at this moment, the bracket is in a locked state; and when a person sits on a seat surface to apply gravity, because the locking pipes symmetrically arranged form a V shape, the sliding piece 8 drives the outer ends of the locking pipes 9 to slide upwards. When the bracket is folded, the outer ends of the locking pipes 9 are pressed downwards by hands. Using a lever principle, an inclined angle between the locking pipes 9 symmetrically arranged forms ⌣ shape and the sliding piece 8 slides downwards.

I claim:

1. A portable folding chair, comprising:

a group of foot pipes;

a group of seat frame pipes;

a group of rotating connection pipes;

a group of locking pipes; and a fabric;

the group of foot pipes comprises a left and a right foot pipes; armrest fixing pieces are fixedly installed on the upper ends of the foot pipes; a limiting piece is fixed in a middle of the foot pipes; a sliding piece is sleeved below the limiting piece; upper ends of the four rotating connection pipes are rotatably connected with the seat frame pipes through a seat frame rotating piece; other ends of the four rotating pipes are rotatably connected with a linkage pipe of the four rotating pipes through a rotating piece fixed thereto; the four rotating connection pipes are symmetrically arranged; a left and a right locking pipes are installed and are symmetrically arranged; middles of the locking pipes are rotatably connected with middles of the rotating connection pipes; a locking piece is arranged the inner end and is rotatably connected with the locking pipe on the other side; the outer end is rotatably connected with the sliding piece sleeved on the foot pipes; a left and a right seat frame pipes are arranged, respectively sleeved on the armrest fixing pieces and rotatably connected with the rotating connection pipes; and the fabric is sleeved on the seat frame pipes.

2. The portable folding chair according to claim 1, wherein armrest pipes are arranged on the armrest fixing pieces and rotate; back rotating pieces are fixedly installed on a back pipe and are rotatably connected with the armrest pipes.

3. The portable folding, chair according to claim 2, wherein the locking pipes is configured to support an unfolded bracket and lock a locked structure in a gravity direction simultaneously.

4. The portable folding chair according to claim 1, wherein after a bracket is unfolded to a position, the locking pipes are symmetrically arranged from an angle from a revised v shape to a v shape; and the locking pieces are fixedly sleeved on the locking pipes are stressed in opposite vertex and naturally locked.

5. The portable folding chair according to claim 1, wherein after being folded, the bracket is compact and can be carried away by one hand like a briefcase.

* * * * *